United States Patent [19]

Ruth et al.

[11] 4,157,366

[45] Jun. 5, 1979

[54] APPARATUS FOR VENTING FUEL VAPORS

[75] Inventors: Harvey L. Ruth, Maryland Heights; Larry J. Tipton, Florissant, both of Mo.

[73] Assignee: ACF Industries, Incorporated, New York, N.Y.

[21] Appl. No.: 886,240

[22] Filed: Mar. 13, 1978

[51] Int. Cl.[2] ..... F02M 5/08

[52] U.S. Cl. ..... 261/72 R; 123/136; 251/130; 261/DIG. 67; 261/DIG. 74

[58] Field of Search .... 261/DIG. 67, 72 R, DIG. 74; 123/136, 198 D; 251/130

[56] References Cited

U.S. PATENT DOCUMENTS

| | | | |
|---|---|---|---|
| 1,669,786 | 5/1928 | Schwalbenberg | 123/198 D |
| 2,636,516 | 4/1953 | Armstrong et al. | 251/130 |
| 2,715,523 | 8/1955 | Moseley et al. | 261/DIG. 67 |
| 2,977,102 | 3/1961 | Roux et al. | 261/DIG. 67 |
| 3,084,676 | 4/1963 | Herion et al. | 251/130 |
| 3,273,871 | 9/1966 | Winkler | 261/DIG. 67 |
| 3,317,136 | 5/1967 | Stang, Jr. et al. | 251/130 |
| 3,548,797 | 12/1970 | Hagihara et al. | 261/DIG. 67 |
| 3,618,581 | 11/1971 | Simonet | 261/DIG. 74 |
| 3,852,381 | 12/1974 | Mick | 261/DIG. 67 |
| 4,062,910 | 12/1977 | Rogerson et al. | 261/DIG. 67 |

*Primary Examiner*—Tim R. Miles

*Attorney, Agent, or Firm*—J. Joseph Muller; Edward H. Casey

[57] ABSTRACT

Apparatus for venting fuel vapors present in the fuel bowl of a carburetor for an internal combustion engine comprises a bowl vent through which fuel vapors discharge when the vent is open. A valve opens and closes the vent. A biasing force is exerted on the valve to close the vent. In response to starting of the engine first and second opening forces are exerted on the valve; these forces being sufficient to overcome the biasing force exerted thereon and open the vent. Each vent opening force is independently sufficient to open the vent and the vent is open when the engine is running even if one of the first and second forces is not exerted on the valve or is insufficient to open the valve.

10 Claims, 3 Drawing Figures

FIG. 1
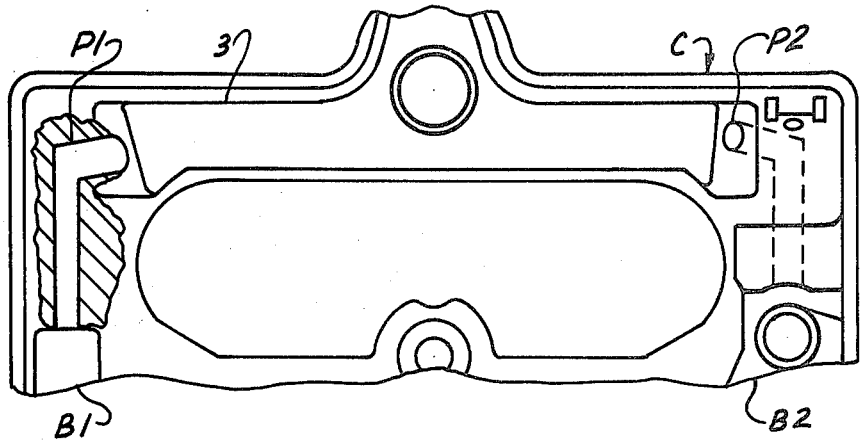
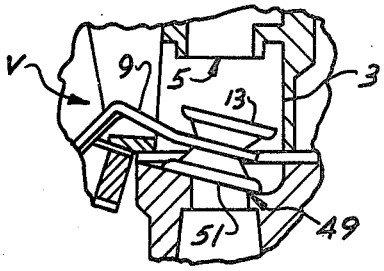
FIG. 3
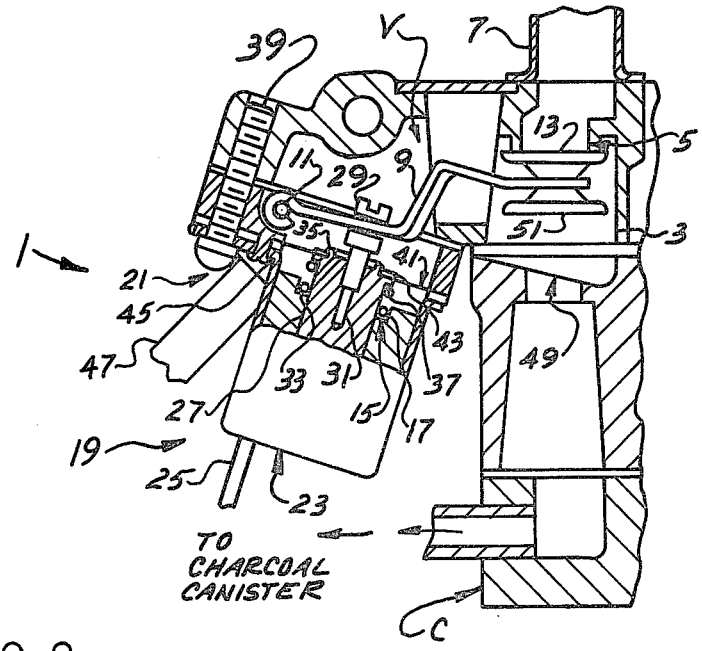
FIG. 2

APPARATUS FOR VENTING FUEL VAPORS

BACKGROUND OF THE INVENTION

This invention relates to carburetors and, more particularly, to apparatus for venting fuel vapors from the fuel bowl of a carburetor.

Carburetor assemblies typically include one or more fuel bowls holding fuel, e.g., gasoline, that is supplied to the engine on which the carburetor is installed. The gasoline gives off vapors and the presence of these vapors in the fuel bowl or bowls creates an internal bowl pressure which may result in an overly rich air-fuel mixture being produced in the carburetor and combusted in the engine.

By venting fuel vapors from the fuel bowl or bowls, the internal bowl pressure is balanced with the outside air pressure and better control over the air-fuel mixture is achieved. However, fuel vapors are continuously produced even when the engine is off and if they are continuously vented they eventually saturate the air space adjacent the carburetor's air inlet or inlets. These vapors gravitate into the carburetor's air horn and the intake manifold of the engine and may displace the air in these regions. Consequently, when the engine is next started, an overly rich air-fuel mixture is supplied to the engine which makes it more difficult to start. Therefore, it is important that vapors be vented only while the engine is running.

Further, it is also important to insure that venting does occur when the engine is running. Most prior carburetor designs in which a fuel bowl vent is incorporated include only a single mechanism for opening the vent. If this fails, venting will not occur and the above-indicated problems will result.

SUMMARY OF THE INVENTION

Among the several objects of the present invention may be noted the provision of apparatus for venting fuel vapors present in the fuel bowl of a carburetor; the provision of such apparatus for venting fuel vapors while an engine on which the carburetor is installed is running; the provision of such apparatus which is fail-safe, that is, it insures that fuel vapors are always vented while the engine is running; the provision of such apparatus which is useful on a carburetor having more than one fuel bowl to vent fuel vapors produced in each fuel bowl; and the provision of such apparatus for balancing the internal pressure in each fuel bowl of the carburetor with outside air pressure thereby to enhance precise fuel metering.

Briefly, apparatus of the present invention is for venting fuel vapors present in the fuel bowl of a carburetor for an internal combustion engine and comprises a bowl vent through which fuel vapors discharge when the vent is open. A valve opens and closes the vent and a biasing force is exerted on the valve to close the vent. First and second means responsive to the starting of the engine exert an opening force on the valve sufficient to overcome the biasing force exerted thereon and open the vent. Each of the first and second means is independently capable of exerting sufficient opening force on the valve to open the vent whereby the vent is open when the engine is running even if one of the first and second means fails to operate or is incapable of exerting sufficient opening force on the valve. Other objects and features will be in part apparent and in part pointed out hereinafter.

BRIEF DESCRIPTION OF THE DRAWINGS

FIG. 1 is a partial top plan view of a carburetor having a pair of fuel bowls;

FIG. 2 is a sectional view of the carburetor of FIG. 1 illustrating apparatus of the present invention in its configuration when the engine on which the carburetor is installed is off; and FIG. 3 is a sectional view similar to FIG. 2 with the apparatus in its configuration when the engine is running.

Corresponding reference characters indicate corresponding parts throughout the several views of the drawings.

DESCRIPTION OF A PREFERRED EMBODIMENT

Referring to the drawings, apparatus of the present invention is generally indicated 1 and is for venting fuel vapors present in the fuel bowl or a carburetor C for an internal combustion engine (not shown). The carburetor may have a single fuel bowl or, as shown in FIG. 1, may have two fuel bowls B1 and B2, respectively. In either event, fuel vapors are produced in each bowl and create an internal bowl pressure which results in an overly rich air-fuel mixture being produced in the carburetor. To prevent this, it is necessary to vent the fuel bowl or bowls to discharge the fuel vapors from them and balance the internal bowl pressure with outside air pressure. With regard to the carburetor of FIG. 1, a chamber 3 is formed in the carburetor body and vapor passages P1 and P2 respectively, communicate between each fuel bowl and the chamber.

As shown in FIGS. 2 and 3, apparatus 1 comprises a bowl vent 5 through which fuel vapors discharge when the vent is open. A vent tube 7 projects upwardly from vent 5 to direct fuel vapors discharging through the vent up into an air cleaner (not shown) which is typically mounted above carburetor C.

A valve, generally indicated V, opens and closes vent 5. The valve comprises a lever 9 pivoted at one end about a pin 11. The lever is rotatable about the pin to move a valve member 13 carried on the other end of the lever with respect to the vent. Counterclockwise rotation of lever 9 about pin 11 brings valve member 13 into sealing contact with vent 5 to close the vent while clockwise rotation of the lever moves the valve member away from the vent and opens it for discharge of fuel vapors from a fuel bowl.

Means generally indicated 15, exerts a biasing force on the valve, i.e., on lever 9, to close vent 5. Means 15 comprises a spring 17 which exerts a counterclockwise rotative force on lever 9 to bias the valve closed. The manner in which the spring exerts this biasing force on the lever is described hereinafter.

First and second means, 19 and 21 respectively, are responsive to the starting of the engine to exert an opening force on valve V sufficient to overcome the biasing force exerted on the valve by spring 17 and open vent 5. First means 19 comprises an electro-mechanical device 23 which is energized when the engine is started and remains energized while the engine is running. Device 23 is a solenoid whose windings are connected to the ignition switch for the engine via a cable 25. The solenoid has an armature 27 connected to lever 9 of valve V to move the lever. When the solenoid is actuated, the armature is pulled downwardly and exerts a rotative force on the lever to move valve member 13 away from vent 5 and open the vent. As shown in FIG. 2, armature 27 is connected to lever 9 by a pin or screw 29 which is inserted through an opening in the lever and received in a longitudinal bore 31 of the armature. Screw 29 is adjustable to obtain better closure of vent 5 by the valve. An annular groove 33 is formed in the body of solenoid 23 adjacent the longitudinal central bore in which the armature moves and at the end of the solenoid nearest the valve assembly. Further, armature 27 has an enlarged diameter section 35 at its outward end, the underside of this section forming a shoulder or bearing surface 37. Spring 17, which is a coil compression spring, seats in groove 33 and bears against shoulder 37 to exert a force on the armature and, via the armature, lever 9 of valve V, which force biases the valve to close vent 5. Solenoid 23 is attached to the body of carburetor C by a plurality of screws 39 one of which is shown in FIG. 2.

Second means 21 is responsive to the vacuum created in the engine and comprises a flexible diaphragm 41 which is disc-shaped and whose outer margin is clamped between the body of carburetor C and solenoid 23 when the solenoid is attached to the carburetor body. The diaphragm has a central circular opening which fits over the outward end of armature 27 and is held in place by a washer 43. After the washer is fitted in place, the end of the armature is spun over to capture the washer and diaphragm. Solenoid 23 has an opening 45 connected to the manifold of the engine by a tube 47. The opening permits the underside of diaphragm 41 to be subjected to engine vacuum when the engine is started and running. The force created on the underside of the diaphragm by the engine vacuum increases as engine vacuum increases, decreases as engine vacuum decreases and is sufficient to overcome the force exerted on armature 27 by spring 17 to move the armature in the same direction (the clockwise direction) it is moved when solenoid 23 is energized therby to move valve V to a vent opening position.

In operation, engine vacuum acting on the backside of the diaphragm will start to pull armature 27 downwardly against the force of bias spring 17 and valve V will open. When solenoid 23 is energized the magnetic field produced will hold the armature in its fully retracted position against the force of the spring so the vent remains open. Thus, even if the engine were operated at a wide-open throttle, low vacuum condition, the vent remains open. Moreover, either the vacuum portion of the apparatus or the solenoid is capable, by itself, of pulling the valve open and keeping it open. Thus, it will be understood that each means 19 and 21 is independently capable of exerting sufficient opening force on valve V to open vent 5. This insures that the vent is open when the engine is running even if one of the two means fails to operate or is incapable of exerting sufficient opening force on valve V. Consequently, if the solenoid fails, or for some reason is not energized, the vacuum portion of the apparatus is still capable of opening the vent and keeping it open. Similarly, if engine vacuum falls off or the vacuum portion of the apparatus does not function, the solenoid is still capable of opening the vent and keeping it open. With the vent open, vapors created in the fuel bowl or bowls of a carburetor discharge through the vent. So, for example, with the vent open, fuel vapors collecting in chamber 3 from fuel bowls B1 and B2 are discharged through vent 5 and the internal bowl pressures are balanced with outside air pressure.

Carburetor C has a second bowl vent 49 connected to a charcoal canister (not shown). The charcoal canister collects vapors created in a carburetor fuel bowl when the engine is not running. As shown in FIGS. 2 and 3, vent 49 is below vent 5 and lever 9 of valve V carries a valve member 51 which closes this second vent when the lever is moved to open vent 5. Conversely, when the valve is moved to close vent 5, (when the engine is shut down) vent 49 is opened and vapors created in a carburetor fuel bowl discharge through the vent and are collected at the canister. The canister in which the fuel vapors are collected is purged while the engine is running through a different path. The vapors are not returned to the fuel bowl, as would occur if vent 49 was left open, because this would effect the precise metering of fuel from the fuel bowl or bowls. It will be understood that valve members 13 and 51 may be formed as a single piece, for example, as a double-sided grommet.

In operation, when solenoid 23 is energized and pulls armature 27 to its fully retracted position, a tight seal is made with respect to vent 49 so all the vapor is drawn off through vent 5.

In view of the above, it will be seen that the several objects of the invention are achieved and other advantageous results attained.

As various changes could be made in the above construction without departing from the scope of the invention, it is intended that all matter contained in the above description or shown in the accompanying drawing shall be interpreted as illustrative and not in a limiting sense.

What we claim is:

1. Apparatus for venting fuel vapors present in the fuel bowl of a carburetor for an internal combustion engine comprising:
   - a bowl vent through which fuel vapors discharge when the vent is open;
   - a valve for opening and closing the vent;
   - means for exerting a biasing force on the valve to close the vent; and
   - first and second means responsive to the starting of said engine for exerting an opening force on the valve sufficient to overcome the biasng force exerted thereon and open the vent, each of said first and second means being independently capable of exerting sufficient opening force on the valve to open the vent whereby the vent is open when the engine is running even if one of said first and second means fails to operate or is incapable of exerting sufficient opening force on the valve.

2. Apparatus as set forth in claim 1 wherein said first means is an electro-mechanical device which is energized when said engine is started and remains energized while said engine is running, the opening force exerted on said valve by said first means being a constant force.

3. Apparatus as set forth in claim 2 wherein said second means is responsive to the vacuum created in said engine when it is running to exert an opening force on said valve, the opening force exerted by said second means increasing as engine vacuum increases and decreasing as engine vacuum decreases.

4. Apparatus as set forth in claim 3 wherein said valve comprises a lever pivoted at one end and a valve member carried on the other end of the lever, said valve member sealingly closing said vent when said valve is moved to its vent closing position.

5. Apparatus as set forth in claim 4 wherein said first means comprises a solenoid whose armature is connected to said lever whereby movement of said armature when said solenoid is energized pivots said lever in the direction to move said valve member to a vent opening position.

6. Apparatus as set forth in claim 5 wherein said biasing means comprises a spring acting on said armature to continuously urge it in the opposite direction to that which it moves when said solenoid is energized thereby to move said valve to its vent closing position, the force exerted by said spring on said armature being insufficient to move said armature when said solenoid is energized.

7. Apparatus as set forth in claim 6 wherein said second means comprises a diaphragm one side of which is subjected to engine vacuum, said diaphragm being attached to said armature to move said armature against the force exerted thereon by said spring in the same direction it is moved when said solenoid is energized thereby to move said valve to its vent opening position.

8. Apparatus as set forth in claim 1 further including a second bowl vent through which fuel vapors are discharged when said engine is not running, said valve closing said second bowl vent when the first said bowl vent is open and opening said second bowl vent when the first said bowl vent is closed.

9. In a carburetor for an internal combustion engine, said carburetor having first and second fuel bowls in which fuel vapors are created, a chamber, a vapor passage communicating between each fuel bowl and said chamber for fuel vapors created in said fuel bowls to collect in said chamber, the improvement comprising apparatus for venting said fuel vapors, said apparatus including a vent through which fuel vapors discharge when the vent is open; a valve for opening and closng the vent; means for exerting a biasing force on the valve to close the vent; and first and second means responsive to the starting of said engine for exerting an opening force on said valve sufficient to overcome the biasing force exerted thereon and open the vent, each vent opening means being independently capable of exerting sufficient opening force on the valve to open the vent, the opening of said vent permitting discharge of fuel vapors collected in the chamber and the balancing of the pressures to which each fuel bowl is subjected and said vent being open when said engine is running even if one of said first and second means fails to operate or is incapable of exerting a sufficient vent opening force on the valve.

10. The improvememt as set forth in claim 9 further including a second vent through which fuel vapors discharge when said engine is not running, said valve closing said second vent when the first said vent is open and opening the second vent when the first said vent is closed.

* * * * *